US005154031A

United States Patent [19]

Wall

[11] Patent Number: 5,154,031

[45] Date of Patent: Oct. 13, 1992

[54] SUSPENDED CEILING SYSTEM AND CONNECTOR CLIP THEREFOR

[75] Inventor: Glen Wall, Pleasanton, Calif.

[73] Assignee: Schilling Components, Incorporated, Pleasanton, Calif.

[21] Appl. No.: 675,425

[22] Filed: Mar. 26, 1991

[51] Int. Cl.[5] ..... E04B 5/52

[52] U.S. Cl. ..... 52/484; 52/667; 403/346

[58] Field of Search ..... 52/484, 726, 665, 666, 52/667; 403/231, 346

[56] References Cited

U.S. PATENT DOCUMENTS

| | | | |
|---|---|---|---|
| 2,689,630 | 9/1954 | Drury | 52/664 |
| 3,093,221 | 6/1963 | Purdy | 52/484 |
| 3,096,862 | 7/1963 | Purdy | 52/484 |
| 3,333,387 | 8/1967 | Deakins | 52/664 |
| 3,385,021 | 5/1968 | Nys | 52/665 |
| 3,565,474 | 2/1971 | Stumbo et al. | 52/667 |
| 3,596,425 | 8/1971 | Kodaras | 52/665 |
| 3,677,589 | 7/1972 | Roles | 52/665 |
| 3,979,874 | 9/1976 | Cubbler et al. | 52/484 |
| 4,161,856 | 7/1979 | Brown et al. | 52/667 |
| 4,389,828 | 6/1983 | Cary | 52/665 |
| 4,494,350 | 1/1985 | Sharp | 52/665 |
| 4,505,083 | 3/1985 | Mieyal | 52/664 |
| 4,535,580 | 8/1985 | Shirey | 52/484 |
| 4,677,802 | 7/1987 | Vukmanic | 52/488 |
| 4,850,172 | 7/1989 | Gailey et al. | 52/665 |

*Primary Examiner*—James L. Ridgill, Jr.
*Attorney, Agent, or Firm*—Poms, Smith, Lande & Rose

[57] ABSTRACT

A suspended ceiling support system is formed of a grid having main runners (12) interconnected by cross runners (16) extending at right angles to the main runners and abutting the main runners at runner intersections. The cross runners are firmly and fixedly interconnected to one another and to the interposed main runner by means of a single connector clip (20) of uniform height throughout its length. The connector clip has end plates (120,124) that connect to opposite sides of the webs (34,144) of respective cross runners and an integral angulated intermediate section (140) extending through a vertical slot (110) in the main runner web (106). The cross runners are formed with opposing channels (40,52,42,54) that slidably receive upper and lower edges of the connector clip and each cross runner web has a hole (99) to receive a locking tongue (126,128) on the clip. Thus a single connector clip firmly and fixedly connects ends of two cross runners to each other and to the interposed main runner.

17 Claims, 6 Drawing Sheets

SUSPENDED CEILING SYSTEM AND CONNECTOR CLIP THEREFOR

BACKGROUND OF THE INVENTION

The present invention relates to a suspended ceiling system and more particularly concerns a suspended ceiling system and an improved connector clip for the runners of the system.

Suspended ceiling systems are extensively used throughout the construction industry, both in new building construction and in the renovation of older buildings. This type of ceiling consists of a grid-like supporting base which is suspended from the true ceiling and which supports a number of ceiling panels, typically of acoustical tile. This suspended grid also may serve as a support base for lighting fixtures and heating and air-conditioning outlet ducts.

The supporting grid itself is formed by two sets of beams joined together at right angles to one another, with main runners extending in a first direction and cross runners extending in a perpendicular directions. The main runners consist of long beam segments parallel to one another, each typically extending across the length of the ceiling. Where this distance is longer than the individual length of a beam segment a number of such segments may be butt-spliced together to create one continuous longitudinal beam. In contrast, the cross runners, which are also parallel to one another, form discontinuous beams extending perpendicular to the main runners and each typically spans only the distance between a pair of adjacent main runners. The grid system thus formed is suspended from the true ceiling by wires or equivalent means attached to the main runners.

Several different systems for the attachment of the cross runners to the main runners are known to the art. They can generally be divided into two groups, the unitary connectors and the separate or piece connectors. Unitary connectors have the connector pieces integrally formed as a part of a cross runner. Such a construction is shown in U.S. Pat. No. 3,979,874 to Cubbler, Jr., et al. The end portions of the cross runners are provided with vertical tabs which are inserted into slots formed in the web portion of the main runners. U.S. Pat. No. 3,565,474 to Stumbo, et al and U.S. Pat. No. 4,161,856 to Brown, et al, are similar, with both providing tongues which project from the ends of the cross members. In Stumbo, et al the tongue is integrally formed with the beam webbing, while Brown, et al provide rivets for the attachment of the tongue portion.

A variety of separate connector pieces are also disclosed in the prior art. U.S. Pat. No. 3,385,021 to Nys provides a connecting plate that is received by grooves in the cross member flanges. The plate is provided with a projecting member which is received by a slot in the main runner. U.S. Pat. No. 3,093,221 to Purdy provides a connecting plate that clips to the cross runner and a spring nose that enters a hole in the main runner. U.S. Pat. No. 3,677,589 to Roles provides an installation clip which connects with the cross member using mating slots, and connects with the main runner utilizing a concave engaging portion. U.S. Pat. No. 3,596,425 to Kodaras provides a clip member which is received by slots in a specially designed main runner. The clip member then attaches to two cross runners using locking tabs.

The great utility, and in fact, popularity, of these ceiling grid suspension systems is directly related to the ease of their on-site installation. In commercial installations particularly, not only is the ease of installation important, but much consideration is also given to adaptability of the system to differing ceiling constructions and the amount of time required for installation.

Many of the simplest and quickest connections of the prior art are provided by connectors integral with the beams. These, however, are more difficult and expensive to manufacture. The separate connector assemblies, while less expensive to manufacture, often experience problems of poor mechanical connection and lack of stability or rigidity of the connection.

In the Sharp, U.S. Pat. No. 4,494,350, a pair of connectors is employed to interconnect two cross runners with each other and with the main runner. In this patent the two connectors are identical and each is slidably inserted into and locked to the web of one of the cross runners by a pair of dimples and includes a narrower projecting tongue extending through a vertical slot in the web of the main runner that has a hole which receives a connecting tab struck out of the web of the adjoining runner. Because the use of dimples these clips are necessarily made of thinner, more flexible material which may inadvertently become bent or distorted so as to increase difficulties of field assembly. Further, the connector clips of the Sharp patent must each be individually assembled to the runner web, and each runner must be formed with both a dimple receiving aperture and a tongue struck out from the cross runner web at a carefully located point. Thus the assembly of a ceiling suspension system employing the connectors of the Sharp patent is more difficult and more time consuming because of use of two thin and flexible connectors that must be individually installed and connected and may experience undesired flexibility and lack of rigidity in assembled condition.

In the arrangement of the Sharp patent, and in many other prior art arrangements, a full height portion of the connector clip is secured to one end of one of the cross runners, but the portion of the connector clip that projects through the interposed main runner and is connected to the second cross runner is of a lesser height and therefore of greatly decreased strength. Moreover, the connection of the clip to the second cross runner is of less rigidity and less strength. For example, in the Sharp patent, one side of the connector slip is slidably received in upper and lower channels formed in upper and lower flanges of one runner, and, even though the other cross runner is formed with the very same channels, the end of the connector clip which extends through the interposed main runner and is connected to the second runner web does not extend into the channels of the second cross runner but has a greatly decreased height and is connected to the second cross runner solely by a tab and hole. Therefore there is less strength and stability in the connection of the clip to the second cross runner.

Accordingly, it is an object of the present invention to provide a ceiling suspension system and connector clip therefor that avoids or minimizes above mentioned problems.

SUMMARY OF THE INVENTION

In carrying out principles of the present invention in accordance with a preferred embodiment thereof main and cross runners of a suspended ceiling grid system are interconnected by means of a single separately attachable connector clip that locks the cross runners to one another and to the main runner. The connector clip is formed of a single elongated plate, of full height throughout its length, having first and second end plate sections extending in parallel but transversely displaced planes along the respective webs of the first and second cross members. The end plate sections are integrally connected by an angulated intermediate plate section that extends in a plane that intersects the planes of the end plates and that is positioned through a vertically extending slot in the web of the main runner, which is interposed between the ends of the two interconnected cross runners. Means are provided to securely connect the end plate sections of the connector clip to the cross runners.

DETAILED DESCRIPTION OF THE PREFERRED EMBODIMENT

Figure 1:
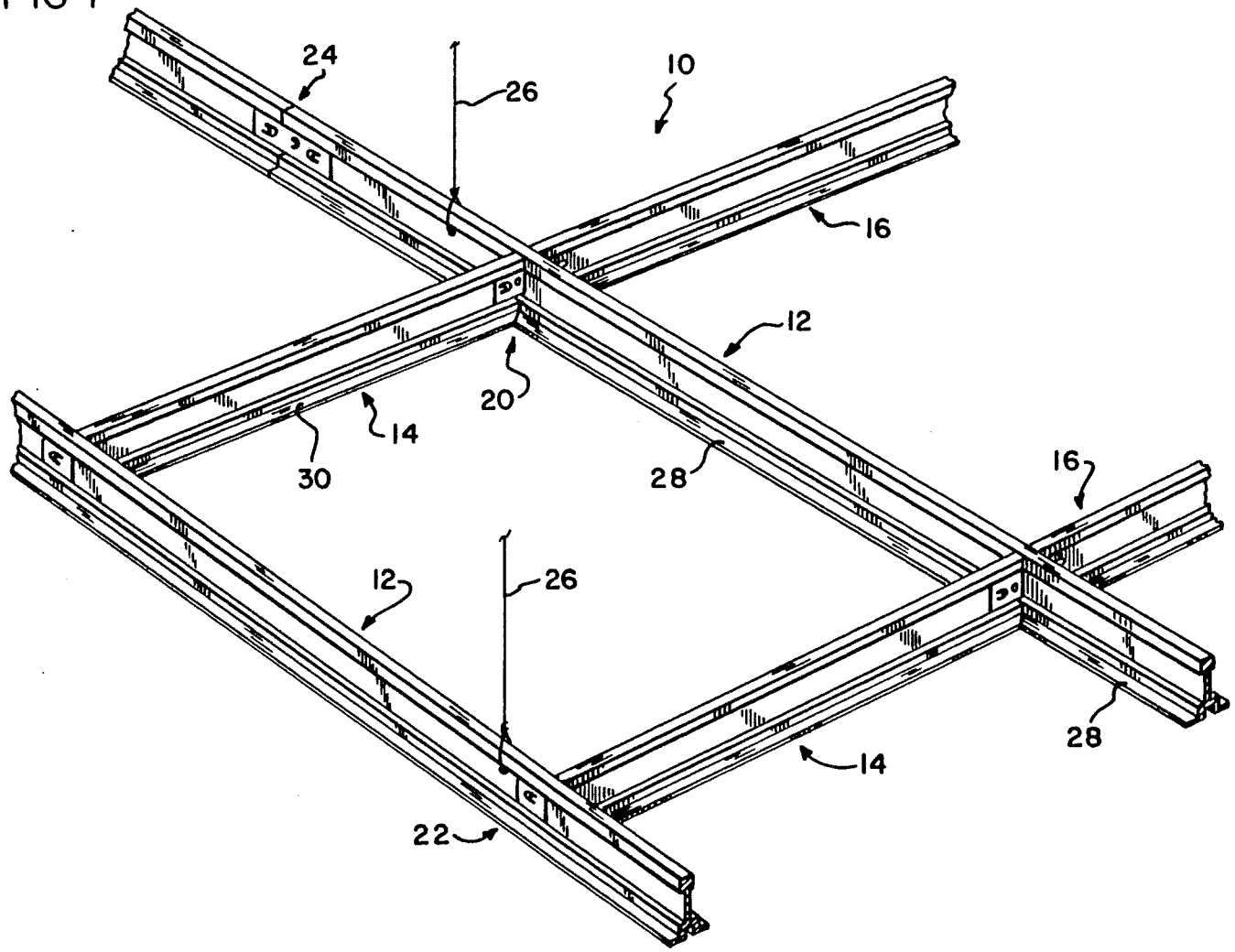
FIG. 1 is a partial perspective view showing a suspended ceiling grid system for supporting ceiling panels.

Illustrated in FIG. 1 is a view of a suspended ceiling grid system, generally indicated at 10, including a plurality of main runners 12 interconnected by cross runners 14 and 16. The main runners 12 run parallel to one another, and the several cross runners run perpendicular to the longitudinal extent of the cross runners but have lengths only from one main runner to the other. The ends of the cross runners abut the main runner, which is interposed between the cross runner ends, and three runners are interconnected at each such intersection by a single connector clip 20 in a manner to be more particularly disclosed hereinafter. The runners are made of a strong, light weight, rigid material, such as extruded aluminum.

Time and effort required for assembly of the ceiling support grid structure are of major significance so that the structure and configuration of the clips that interconnect the several runners to one another are important factors. Since the suspended structure must have the interconnections strong and rigid so as to properly support a stable set of ceiling panels, the strength and rigidity of the interconnections provided by the connector clips is also a major consideration.

Where a cross runner, such as runner 14, intersects a main runner on the perimeter, there is a connection of only two of the runners, a single cross runner and a main runner, and thus an angled connector clip 22 is used at such an interconnection.

Where the extent of the area to be covered by the ceiling is greater than the length of a main runner, two main runner sections may be abutted to one another and spliced for interconnection by a splice connector, such as that indicated at 24 in FIG. 1.

The entire grid of runners is suspended from the true ceiling of the building structure by means of wires 26, of which two are illustrated in FIG. 1.

Figure 2:
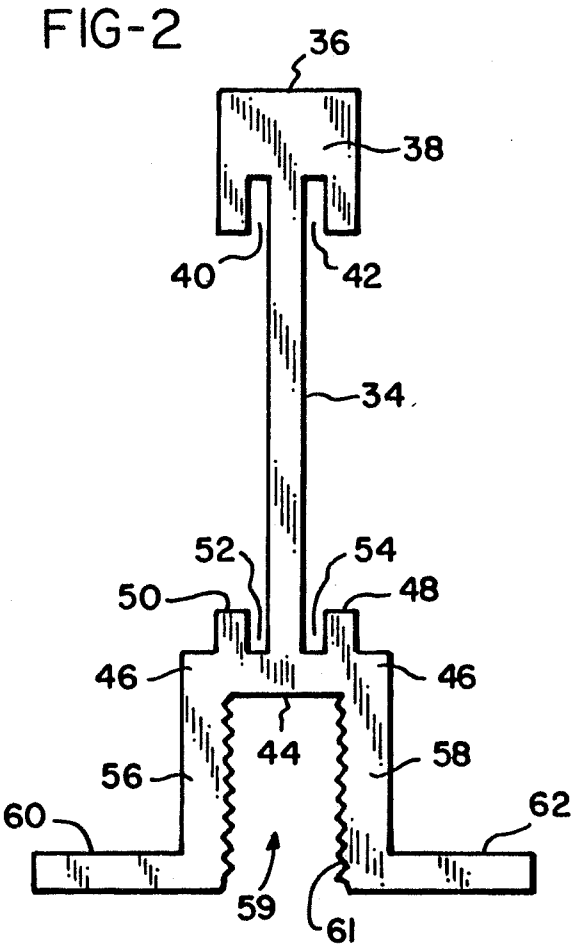
FIG. 2 is a cross section of a typical runner.

The main runners are formed with longitudinally extending horizontal ceiling panel support flanges 28 (FIG. 1) which cooperate with the similar longitudinally extending horizontal ceiling panel support flanges 30 of the cross runners to support a panel such as a rectangle of acoustic sheet material or the like (not shown) that may be placed in the respective rectangular sections of the grid so as to rest upon the ceiling panel support flanges 28,30 of the several runners. Each of the runners, the main runners and the cross runners, which are aluminum extrusions, has the same cross section, which is illustrated in FIG. 2. Each runner includes a longitudinally extending vertical web 34, having an upper edge 36 formed with an integral flange 38 laterally extending from both sides of the web. The lower side of the flange 38 on both sides of the web 34 is formed with a longitudinally extending groove or channel 40,42 for slidable reception of an upper edge of a connector clip. A lower edge 44 of web 34 is formed with a longitudinally extending flanges 46 outwardly projecting on either side of the web and having longitudinally extending upwardly projecting ribs 48,50 on opposite sides of the web that cooperate with the web to form lower clip receiving grooves or channels 52,54 that extend longitudinally. Extending downwardly from both sides of the lower flanges 46 of the lower end of web 34 are first and second support legs 56,58 which terminate in integral, outwardly projecting horizontal flanges 60,62 which form the ceiling panel support flanges 28,30 illustrated in FIG. 1.

Legs 56,58 collectively form a longitudinally extending slot 59, between the legs, having vertical walls on either side of the slot formed with teeth 61 that effectively define an elongated threaded channel for receiving a threaded fastener that may be used for securing various structures, such as lighting fixtures and air-conditioning ducts, to the grid structure.

The cross runners are spaced along the main runners at predetermined distances, and at each location along the main runner that a cross runner is to be connected, the main runner is formed with a mitered recess, such as the recess 64 (FIG. 4) formed by edges 66,68 of main runner flange 62, which is cut away to expose flange edges 66,68 which extend at 45° to the extend of the flange 62.

Figure 3:
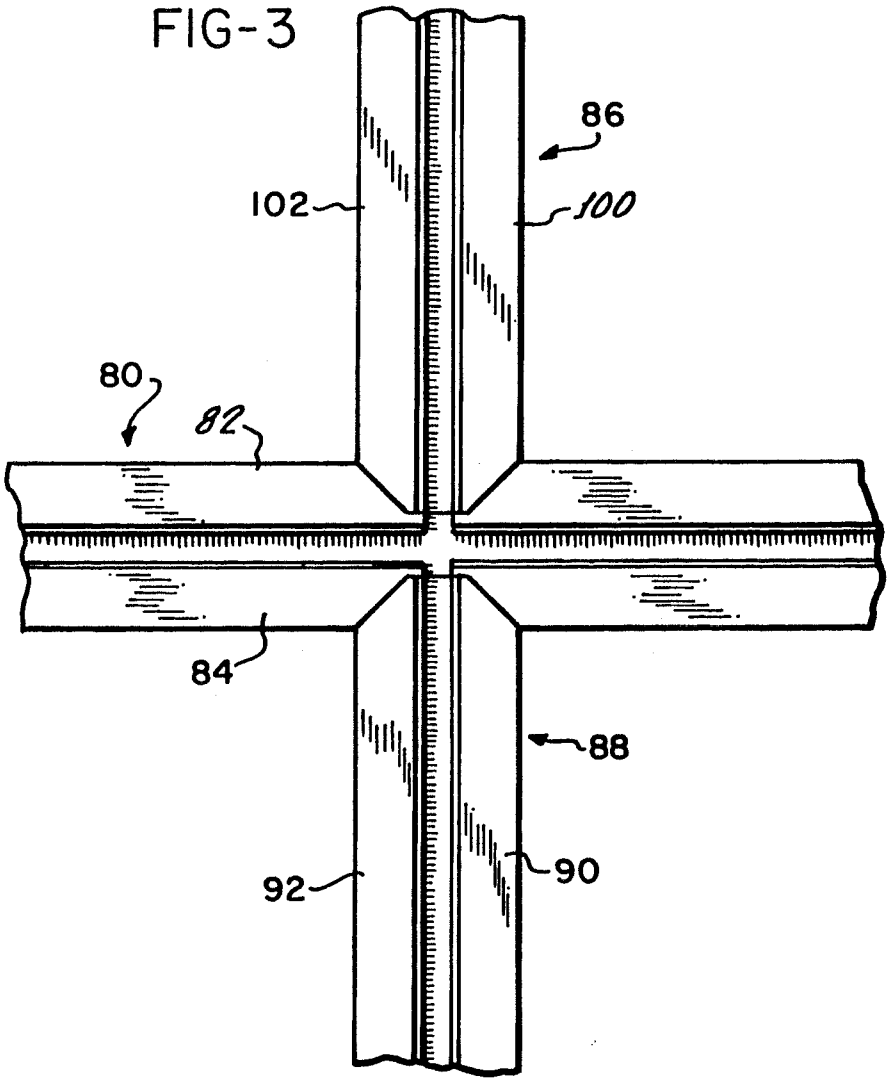
FIG. 3 is an enlarged plan view of a cross runner and main runner interconnection showing the mitered end and mitered recess of the cross and main runners.
Figure 4:
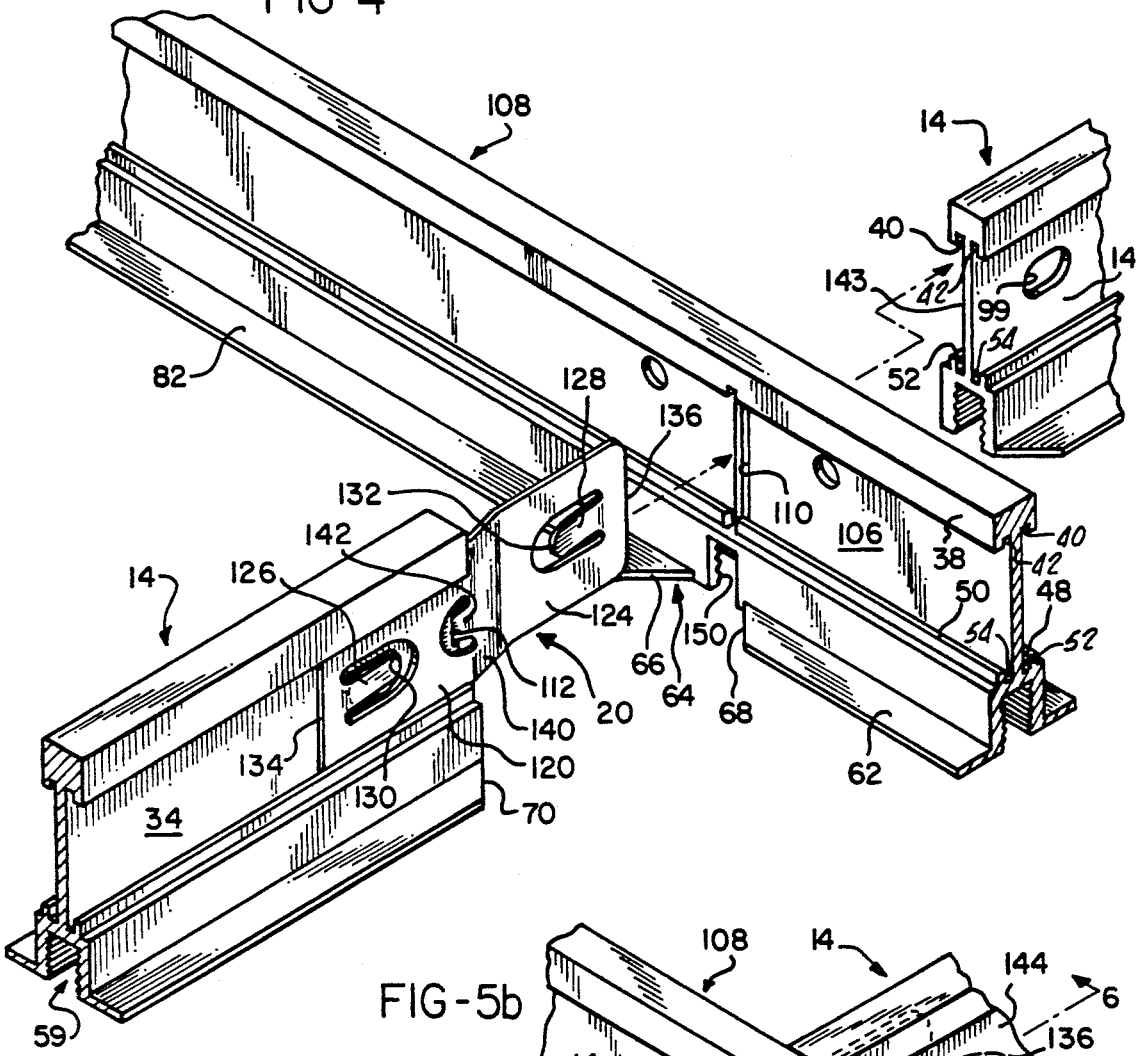
FIG. 4 is an exploded perspective view of a pair of cross runners, connector clip and interposed main runner.

The ends of flanges 30 of each of the cross runners that abut the main runner, are mitered, as indicated at 70 in FIG. 4, so that the mitered ends of the cross runners are each received in opposite mitered recesses of the flanges of the main runners. Thus, for example, as illustrated in FIG. 3, a main runner 80, having flanges 82,84 on opposite sides thereof, is interconnected with first and second cross runners 86,88, having flanges 90,92 and 100,102, respectively. The cross runner flanges are mitered to be received in mitered recesses of the main runner flanges 82,84 to provide a larger area of abutment and a stronger interlocking interengagement between the mitered cross runner flanges and the recessed main runner flanges which receive the cross runner ends.

Figure 5B:
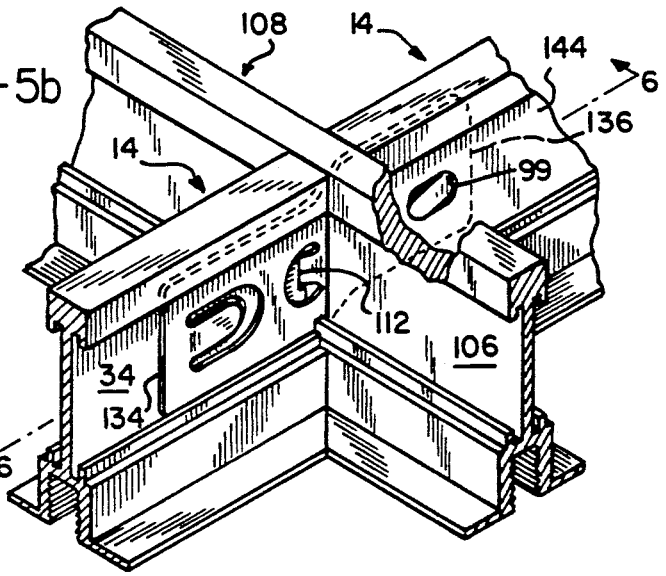
FIG. 5 is a perspective view of the assembled interconnection of FIG. 4.
Figure 5A:
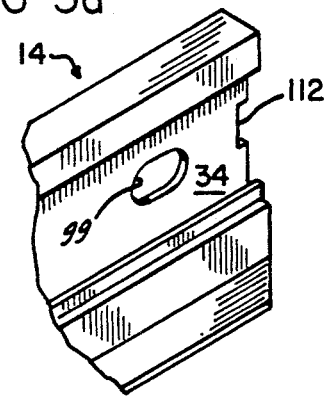

At the location of each cross runner the web 106 (FIG. 4) of a main runner 108 is formed with a vertically extending through slot 110 that extends toward the upper and lower ends of the web. The slot extends to the upper end of channels 40,42 at the upper edge of the web, and to the bottom of channels 52,54 at the lower edge. Thus the slot 10 extends partly through the upper flange 38 and through lower channel forming ribs 48,50. Each cross runner web is formed with a longitudinally elongated hole 99 adjacent its end for locking the web of the cross runner to the connectors. Further, the end of the web of one of the cross runners is formed with a shallow notch or recess 112, as best seen in FIG. 5*a*.

The connector clip, generally indicated at 20 in FIG. 4, is an elongated plate having a uniform height for its full length and made of a strong, resilient metal, such as steel. The connector plate incudes first and second end plate sections 120,124, having integral tongues 126,128 formed therein and bent out of the plane of the plate. Each of the tongues has its free end 130,132 extending longitudinally away from the ends 134,136, respectively, of the connector plate so that the tongue free ends point toward one another. The two end plate sections lie in parallel but mutually transversely displaced planes so that when end plate section 134 is received in channels formed in the upper and lower flanges of one cross runner, and thereby lies adjacent one side of the web of such cross runner, the other end plate section of the same connector will be received in the upper and lower channels extending along the opposite side of the web of the other cross member and will lie along such opposite side. The two end plate sections are transversely displaced from each other by the thickness of the runner webs. Sections 120 and 124 are integrally formed with an angulated intermediate section 140 extending between them. The intermediate section has a short tongue 142 struck out therefrom with the free end of tongue 142 facing toward the connector edge 134 and toward the free end of tongue 126.

Figure 6:
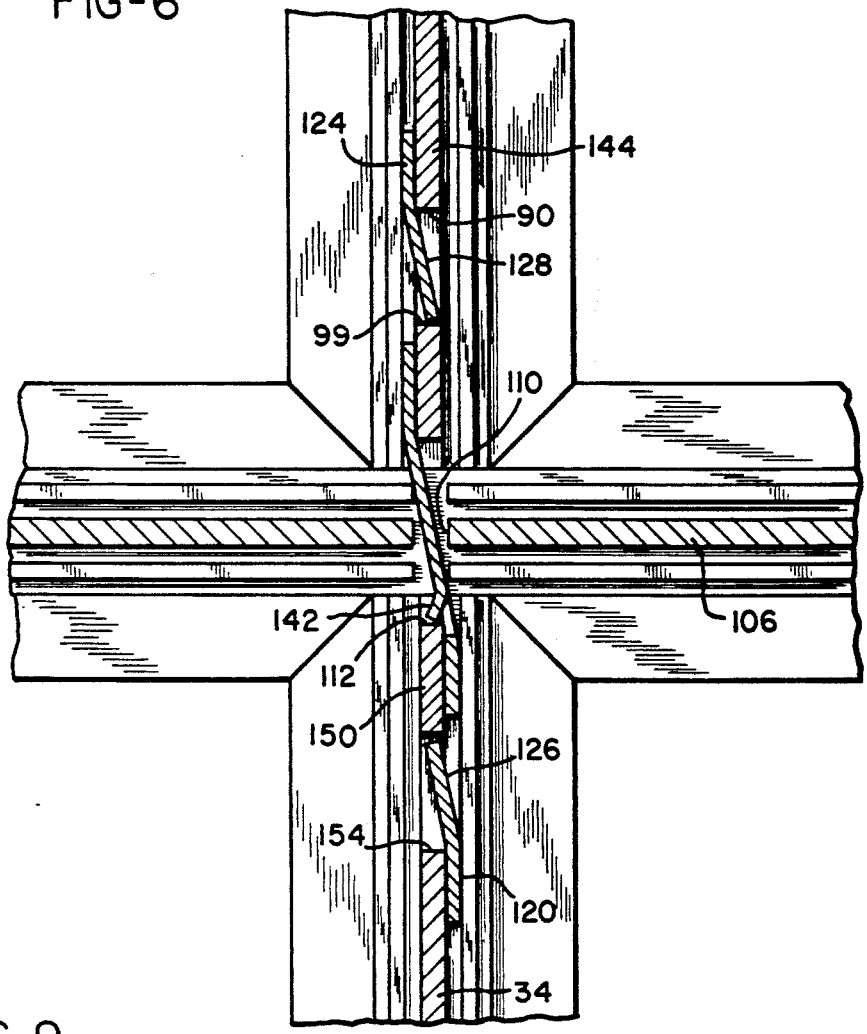
FIG. 6 a longitudinal sectional view showing the relation between the connector clip and the runners in assembled condition.
Figure 9:
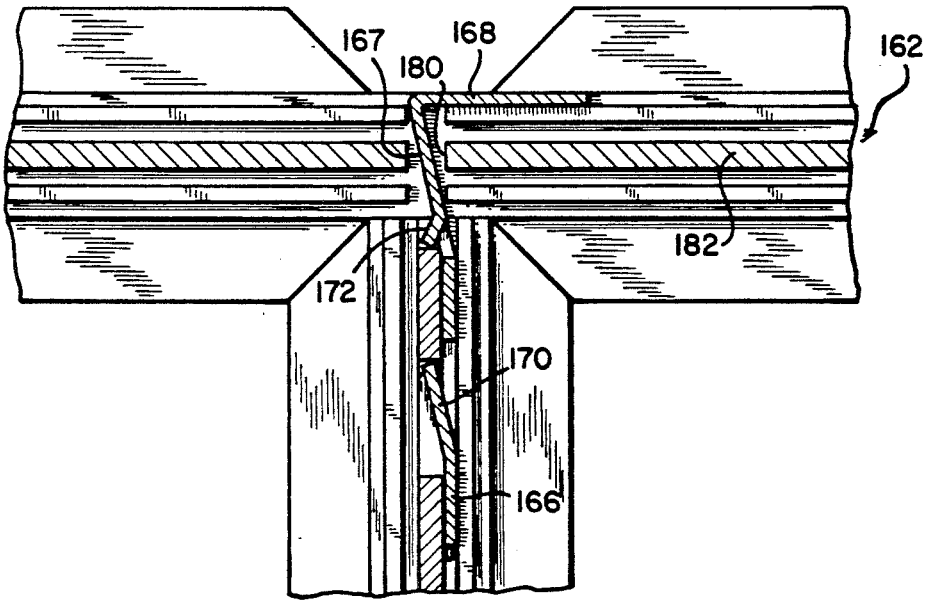
FIG. 9 is an exploded perspective view of a pair of sections of a main runner to be spliced together by a modified connector clip.

As can be seen in FIGS. 4, 5 and 6, the connector plate not only has a uniform height, but also has a uniform thickness for its full length, and the integral intermediate section is bent from the end sections at a relatively small angle that causes the intermediate section to extend between the two end sections and through the slot 110 at such small angle.

For assembly of a pair of cross runners to a main runner, connector 20 is first slid into a pair of channels, such as channels 42,54 on one side of its web 34, with the tongue 126 in end plate section 120 bent outwardly from the plane of the end plate section toward the web of the cross runner. As the end plate section is slid into the channels along the web the tongue is cammed inwardly and pushed back toward alignment with the body of the end plate section until the end 130 of the tongue reaches the hole in the web 34 of cross runner 14 and then resiliently springs into the hole to prevent withdrawal of the connector from the channels of the cross runner. The smaller locking tongue 142 is positioned so that just as, or immediately after, the tongue 126 snaps into the hole of web 34 the free edge of tongue 142, which also is bent outwardly toward the web of the cross runner, will abut the bottom of notch 112 in the end of the cross runner web. This prevents further sliding motion of the connector into the cross runner channels. Accordingly, the connector clip is now locked in place within the cross runner channels, with tongue 126 preventing motion of the connector clip toward the right as viewed in FIG. 4 relative to the cross runner and with the locking tongue 142 preventing motion of the connector clip relative to the cross runner toward the left as viewed in FIG. 4. Lateral motion of the connector clip is restrained by the clip receiving channels.

The connector clip, now firmly secured to the end of the cross runner, has its second end plate section 124 inserted through the slot 110 of the main runner web 106. The mating cross runner 14 on the other side of the main runner 108 is positioned so as to receive in its channels 40,52 the second end plate section 124, which thus slides along the opposite side of the web of the second cross runner. Tongue 128 of the second end plate section of the connector clip is bent outwardly toward the plane of the web of the second cross runner and is resiliently pressed toward the body of end plate section 124 by sliding along the side 143 of the web of the second runner section. As the second end plate section 124 slides further into the channels 40,52, the end of tongue 128 snaps into the hole 99, thereby completing the locking and assembly of the main runner with its two cross runners, as shown in FIG. 5*b*.

FIG. 6 shows the relation between the several parts of FIGS. 4 and 5 in assembled condition, illustrating the first end plate section 120 lying along one side of web 34, and the second end plate section 124 lying along the opposite side of web 144 of the other cross runner. The secure locking action of the two tongues 126 and 142, which effectively grasp the end of the web 34 between the web hole 99 and the web end notch 112, prevents motion in either direction of the connector relative to the cross runner. Tongue 142 is relatively short compared to the length of tongues 126 and 128, so that it will not interfere with the sides of the slot 110 formed in the web 106.

As can be seen in FIG. 6, tongue 128 of the second end plate section 124 of the connector clip is snapped into the aperture 99 of the web 144 of the second cross runner and thus locks the second cross runner to the connector clip. With the connector clip locked to the cross runner webs, the cross runners are held firmly in abutment against opposite sides of the main runner, with the mitered ends of the flanges of the cross runners received in the mitered recesses of the flanges of the main runner, and with ends of at least the lower flanges 38,46 of the cross runners abutting the sides of the upper and lower flanges of the main runner.

With the interconnected cross runners in place, the fastener receiving slots 99 thereof are in mutual longitudinal alignment with one another and also in longitudinal alignment with a transverse slot 150 that extends through the lower edge legs 56,58 of the main runner. This provides a single threaded fastener receiving slot extending continuously through and along the lower edge of cross runner 14, through the main runner, and then through and along the lower edge of the adjoining cross runner.

Figure 8:
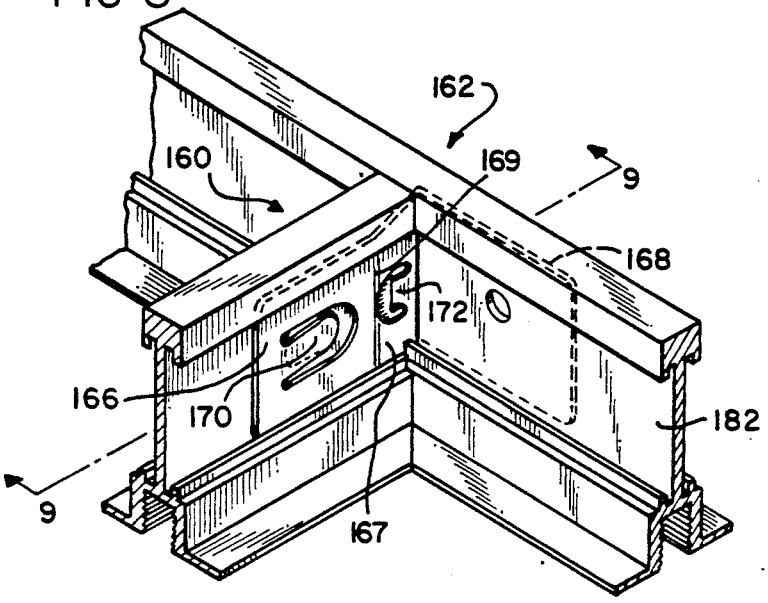
FIG. 8 shows the assembled connection of FIG. 7.
Figure 7:
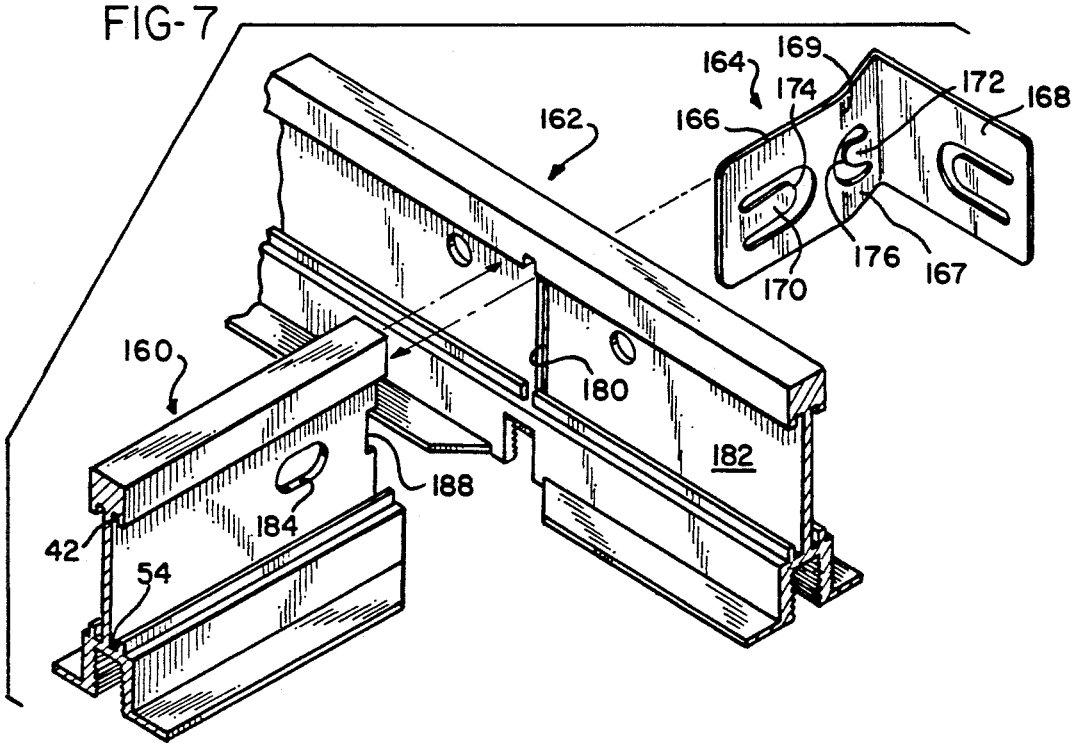
FIG. 7 is an exploded perspective view of the connection between a single cross runner and a main runner, employing a modified connector clip.

Illustrated in FIGS. 7 and 8 is a connection between a cross runner 160 and a main runner 162 that is at the perimeter of the grid, so that there is no second cross runner to be connected at this intersection. The main runner and cross runner are configured and arranged exactly as are the main runner and cross runner for a connection, such as that illustrated in FIGS. 4 through 6, but the resilient steel connector 164 is different, since there is no second cross runner. Connector 164, like the connector 20, is formed of first and second end plate sections 166,168 with the latter being bent at substantially a right angle with respect to end plate section 166. This plate, too, has a single, uniform and full height throughout its length. Plate section 166 may be slightly bent along a bend line 169 to form an angulated intermediate section 167 for better alignment with the web of the cross runner to which it is attached. The end plate section 166 is slightly longer than end plate section 168 and is formed with a pair of locking tongues 170,172 struck out from the body of the end plate section 166, being bent outwardly in the same direction from the end plate section but with the tongue 170 being longer than the tongue 172 and having its free end 174 facing toward the free end 176 of the shorter tongue 172 in a manner similar to the configuration and interaction of the tongues 126,142 of the connector 20.

For assembly of a single cross runner 160 with the main runner 162 of FIG. 7, the angulated connector clip 164 is positioned as generally illustrated in FIG. 7 with the longer, bent end plate section 166,167 pointed toward and transverse to the plane of the web of the main runner 162. This end plate section 166 and angulated section 167 are then slid through the slot 180 in the web 182 of main runner 162, and then into the upper and lower channels 42,54 at the upper and lower edges of cross runner 160. As the end plate section 166 is slid into the cross runner, the latter is pushed into the mitered slot in the flanges of the main runner so that the cross runner abuts the main runner, and the tongue 170 will then snap into the aperture 184 of the cross runner web. The end of locking tongue 172 is received in notch 188 in the edge of the cross runner web. The angled second end plate section 168 of the connector is pulled against the sides of the lower flanges of the main runner when the two tongues 170,172 snap into place against the cross runner and the latter is in its proper position of abutment against the main runner. Thus the two runners are locked together by this angulated clip and assume the assembled position illustrated in FIG. 8. As previously described, end plate section 166 has an inner intermediate portion 167 bent from the plane of section 166 about a fixed line 169 to effectively shift this intermediate clip portion laterally of the cross runner web for alignment with the slot 180 and the cross runner web. This facilitates assembly since plate section 166 is at the side of the cross runner, whereas the slot 180 is aligned with the center plane of the cross runner web of the mitres.

Figure 10:
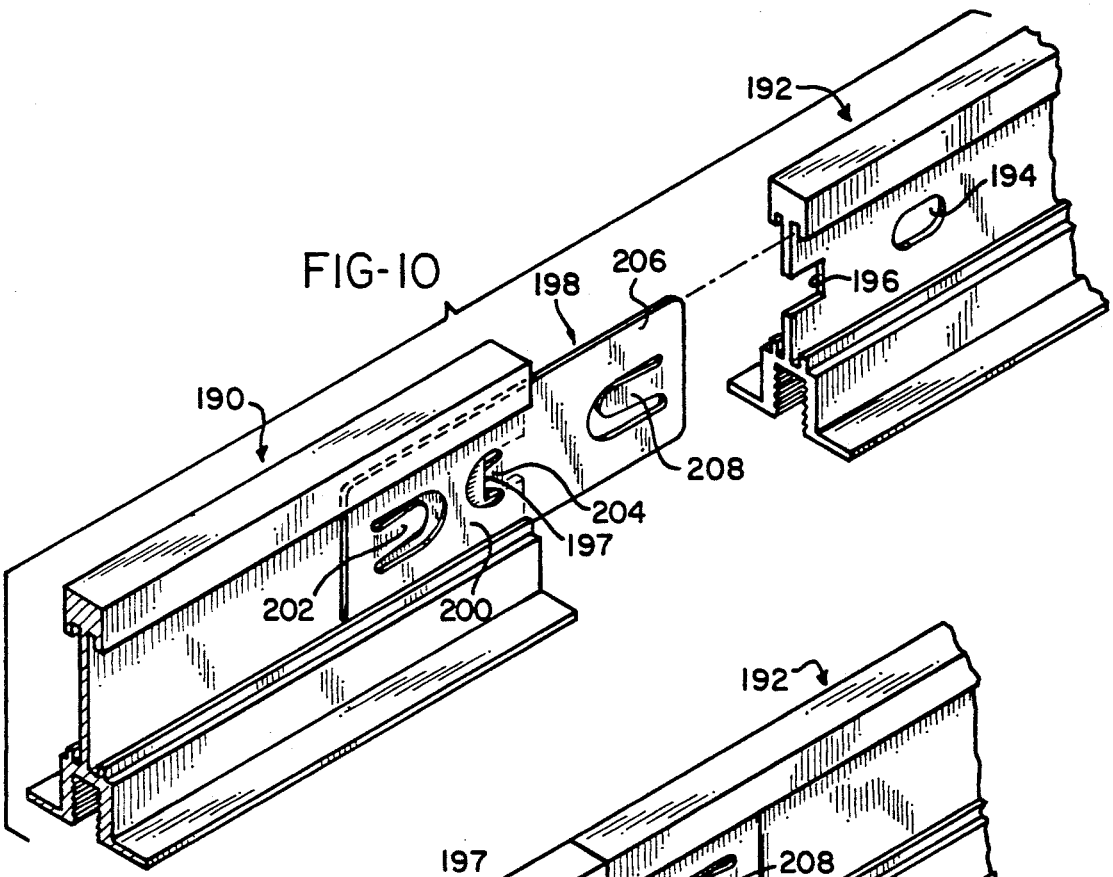
FIG. 10 shows the assembled spliced connection of FIG. 9.

The same basic full uniform height clip configuration, without any clip bends, is employed for making a longitudinal splice between two end abutted main runners. As illustrated in FIG. 10, a first main runner 190 is butted up against a second main runner 192, each having an aperture, such as aperture 194, formed in its web adjacent an end. Each of the main runners is formed with a slot or recess 196, 197 opening outwardly from the end of its web. A connector clip 198 for this splice is formed of a single straight, full height, elongated, resilient steel plate, having a first end plate section 200 in which is formed a tongue 202, just like the tongue 126 of connector clip 20. At an intermediate portion of the connector clip 190 is formed a second tongue 204 like the tongue 142 of connector 20, with the two free ends of the tongues facing each other, just as previously described. At the opposite end of the straight integral connector plate is a second end plate section 206 in which is formed a third tongue 208, analogous to the tongue 128 of clip 20. However, in the case of the connector splice connector clip of FIG. 10, tongue 208 is struck out from the body of the connector clip in the same direction as are the tongues 202 and 204.

In assembly of the spliced connector and the two main runners, the end plate section 200 of the connector is first slid into the upper and lower channels of main runner 190 from an end thereof, with all of the tongues projecting from the plane of the connector toward the main runner web. The connector is slid into the main runner channels until the tongue 202 snaps into the hole at the end of the main runner. When tongue 202 snaps into the aperture in the web of main runner 190 the locking tongue 204 just abuts the bottom of recess 197 of the end of the runner web. Now the second main runner may be moved toward the sub-assembly of connector clip and first main runner to slide the end plate section 206 into the upper and lower channels on the same side of the web of the runner 192 as are the channels which receive the connector end plate section 202. As before, in all assembly operations the tongue 208 projecting toward the web of runner 192 is pressed somewhat toward the body of the end plate section by the web as it slides into the web channels until the tongue 208 reaches a position where it may snap into the hole 194. In this position the two main runner sections have their ends abutting one another, as shown in FIG. 10. Further, the short locking tongue 204 in assembled position is received in the slot 196 formed in the end of the web of runner 192 so that the web of the latter will not cam the locking tongue 204 back into the plane of the connector plate.

Figure 11:
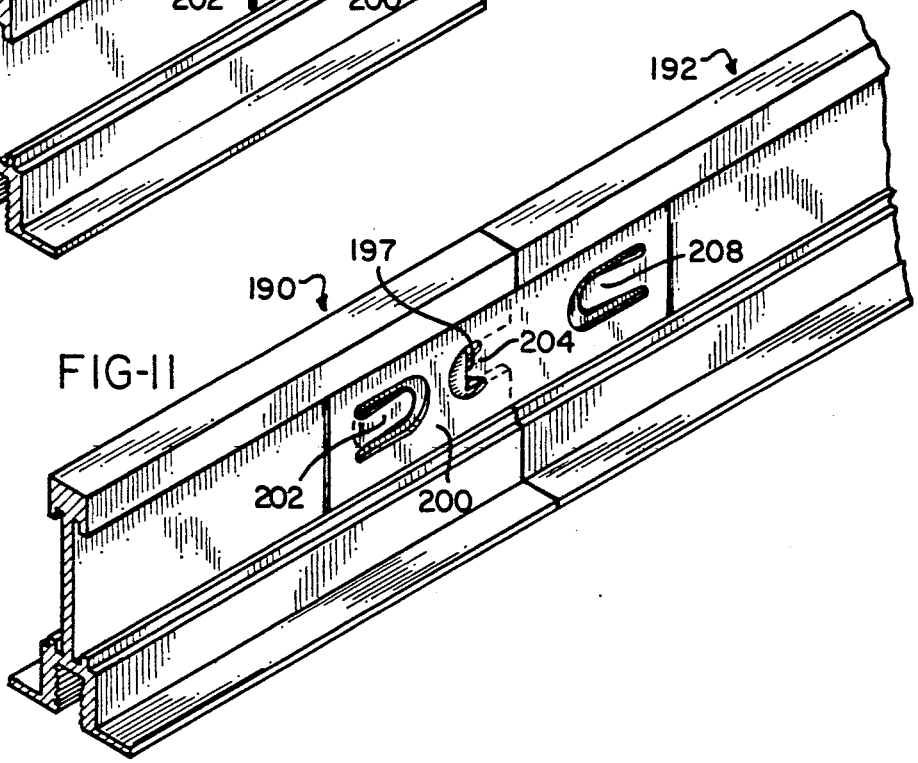

There have been described several different types of connectors, a cross connection connector used for a connection of the type shown in FIGS. 3 through 6, a perimeter connector used for connections of the type shown in FIGS. 7 and 8, and a splice connector for splice connections of the type shown in FIGS. 10 and 11. Each of the three connectors may be formed from the same elongated, full uniform height, metal plate, and each may be formed with the same number, location and configuration of tongues struck out therefrom, differing only in that two tongues of clip 20 extend outwardly from one side of the clip, whereas the third tongue of this clip extends in the other direction, and whereas all three tongues of the splice connector extend outwardly from the same side of the clip.

The angle connector clip 164 of FIGS. 7 and 8 may readily be made from one of the other connector clips. The connector clip configuration is readily manufactured in quantity, with only minor modifications of bending of the clip being required to distinguish one clip from the other.

All of the described clips provide simple, rapid and easy assembly without any type of tools by just sliding the clips into the receiving channels to snap them into place where they are locked to the runners. Further, only a single clip is required for any one connection so that the time involved in assembling the various elements is greatly decreased. Not only is assembly simple, rapid and without tools, but the resulting connection is of great and, indeed, unexpected strength. For example, codes of the State of CA require a test of 180 pounds tension in a pull-out test of the clip (exerting longitudinal tension forces at opposite ends of a pair of cross runners connected by one of these clips). Prior connectors will often have a pull-out strength of 200 to 290 pounds, whereas a connector clip having the configuration illustrated herein has been shown to have a pull-out strength of 375 pounds in standard pull-out tests.

It may be noted that because the connector clip receiving slot, such as slot 110 in web 106, is extended beyond the full height of the web and partly into the upper and lower end flanges, the connector clip, for its entire length, has the same full height as the distance between upper and lower clip receiving channels of the runners. In this arrangement it is not necessary to decrease the height of the portion of the connector clip that projects beyond the end of the cross runner to which it is initially connected. In fact, this arrangement provides greatly increased strength in that the second end plate section 124, having the same full height as the first end plate section 120, can be received in upper and lower channels 40,52 of the second cross runner to further rigidify the interconnection between the connector clip and the second cross runner. In many of the prior art clip arrangements, on the other hand, the connector clip cannot be received in and laterally secured to both cross runners by a simple sliding interconnection between the connector clip edges and a pair of clip receiving channels in both cross runners.

I claim:

1. A suspended ceiling grid system comprising:

an elongated main runner including a web having upper and lower edges and a slot extending through the web and having a height that extends from said upper to lower edges, first and second elongated cross runners aligned with one another and having ends, each cross runner comprising a web having upper and lower edges, said cross runner webs each having first and second sides, said first sides of said first and second cross runners lying in a first common plane, and said second sides of said first and second cross runners lying in a second common plane displaced from said first common plane by the thickness of said cross runner webs, said cross runner ends being in abutment with respectively opposite sides of said main runner, connector clip means for locking said cross runners to one another and to said main runner, said connector clip means comprising:

an elongated plate having a height equal to the height of said slot, and having first and second end plate sections extending respectively in said first and second common planes and extending along respective ones of the webs of said first and second cross runners, and an angulated intermediate plate section integrally connecting said first and second plate end sections and extending in a third plane that intersects said first and second common planes at a relatively small angle, said angulated intermediate section of said connector clip means being bent from said end plate sections, and extending through said main runner web slot at said relatively small angle from said first common plane to said second common plane, means for securing said first end plate section to said first cross runner, and means for securing said second end plate section to said second cross runner.

2. The system of claim 1 wherein said means for securing said first end plate section includes means on said angulated intermediate section for locking said first end plate section to said first cross runner web.

3. The system of claim 1 wherein said means for securing said first end plate section comprises a hole formed in the web of said first cross runner web and a tongue struck out of said first end plate section of the connector clip means and having an end portion extending into said hole.

4. The system of claim 3 including a second tongue struck out of said angulated intermediate section and having an end abutting an end of said web of said first cross runner, thereby locking said connector clip to said first cross runner by the engagement of both said tongues with said first cross runner web.

5. The system of claim 1 wherein said main runner and at least one of said cross runners has a lower edge and each includes an elongated ceiling panel support flange extending from said lower edge in a direction substantially perpendicular to the web thereof, the support flanges of said cross runner being mitered at said end of said cross runner, and the support flanges of said main runner having a mitered recess adjacent said main runner web slot closely receiving the mitered ends of the support flanges of said first cross runner.

6. The system of claim 5 wherein said lower edges of said cross runners each includes a longitudinally extending fastener receiving channel that opens in a direction away from said web, said fastener receiving channels of said first and second cross runners being in mutual alignment with one another, and wherein said lower edge of said main runner is formed with a transversely extending fastener receiving slot that opens away from said main runner web, said transversely extending slot being registered with the fastener receiving channels of said first and second cross runners to provide a continuous fastener receiving channel from said first cross runner to said second cross runner extending through said main runner lower edge.

7. The system of claim 1 wherein said first cross runner includes upper and lower longitudinal flanges on said upper and lower edges respectively, said flanges respectively defining longitudinally extending upper and lower channels between each flange and the web, said first end plate section having upper and lower edges slidably received in said upper and lower channels respectively, said means for securing comprising means for preventing relatively slidable motion of said connector clip first end plate section with respect to said first cross runner after said first plate end section has been slidably inserted into said upper and lower channels.

8. The system of claim 7 wherein said means for preventing relative slidable motion comprises a hole formed in the web of said first cross runner, a tongue extending from said first connector clip end plate section into said hole, and a second tongue extending from said angulated intermediate plate section into engagement with an end of said first runner web.

9. The system of claim 7 wherein said clip means has a height throughout its length equal to the distance between upper and lower channels, and wherein said slot has a height equal to said clip height.

10. For use with a suspended ceiling grid system wherein an elongated main runner is interconnected to and interposed between a pair of cross runners extending at right angles to the main runner, an improved connector clip for connecting the cross runners to each other and to the interposed main runner, said connector clip comprising:

an elongated plate having first and second end plate sections extending respectively in first and second parallel and mutually displaced planes, an angulated intermediate section integrally connected with and bent from said first and second plate end sections and extending in a third plane that intersects said first and second planes at a relative small angle, said plate having a uniform height and thickness throughout the length of all said sections, and means for securing said connector clip to first and second cross runners on opposite sides of a main runner.

11. The apparatus of claim 10 wherein said means for securing comprises first means on said first end plate section and second means on said angulated intermediate section for securing said connector clip to a first one of said cross runners.

12. The apparatus of claim 10 wherein said cross runners each includes a web having a thickness, said webs of said cross runners being mutually aligned with each other on opposite sides of said main runner and wherein said first and second end plate sections of said connector clip are mutually displaced from one another by a distance equal to the thickness of said webs.

13. A suspended ceiling grid system comprising:

an elongated main runner including a web having upper and lower flanges and a slot extending through the web, first and second elongated cross runners aligned with one another and each having an end, each cross runner comprising a web having upper and lower flanges and an end, said cross runner ends being adjacent respectively opposite sides of said main runner, said upper and lower flanges of said cross runners having longitudinally extending upper and lower channels formed therein adjacent a side of the runner web, connector clip means for locking said cross runners to one another and to said main runner, said connector clip means comprising:

an elongated plate of uniform height and thickness throughout its length having first and second end plate sections, an intermediate plate section integrally connecting said first and second plate end sections and extending at a relatively small angle relative to said plate sections through said main runner web slot, said first and second end plate sections being received in upper and lower channels of said first and second cross runners respectively to thereby secure the end plate sections laterally to said cross runners, and means for securing said first and second end plate sections to said first and second cross runners respectively.

14. The system of claim 13 wherein each said plate section has a height extending between upper and lower channels that is equal to the distance between bottoms of the upper and lower channels.

15. The system of claim 14 wherein said main runner has upper and lower flanges forming longitudinally extending upper and lower channels adjacent sides of the main runner web, said slot having a height equal to said distance and extending through said main runner flanges.

16. The system of claim 13 wherein said cross runners include webs each having first and second sides, said first cross runner having its upper and lower channels adjacent the first side of its web, and said second cross runner having its upper and lower channels adjacent a side of its web opposite said first side of the web of said first cross runner, said first end plate section being received in said upper and lower channels of said first cross runner adjacent the first side of the web of said first cross runner, and said second end plate section being received in the upper and lower channels of said second cross runner adjacent the second side of the web of said second cross runner, said first and second cross runners being mutually aligned with one another, and said intermediate section extending at an angle to each of said first and second end plate sections.

17. The system of claim 16 wherein said first and second end plate sections are transversely displaced from each other by the thickness of the webs of said cross runners.

* * * * *